United States Patent [19]

D'Agaro et al.

[11] Patent Number: 4,893,714

[45] Date of Patent: Jan. 16, 1990

[54] SUPPORT FOR PRINT-OUTS

[75] Inventors: Amos D'Agaro, Udine; Giuliano Cossetti, Tolmezzo; Elio Capellari, Udine, all of Italy

[73] Assignee: Seima Italiana SpA, Tolmezzo, Italy

[21] Appl. No.: 158,220

[22] Filed: Feb. 19, 1988

[30] Foreign Application Priority Data

Jul. 21, 1987 [IT] Italy ..... 60411/87[U]

[51] Int. Cl.[4] ..... A47F 7/16

[52] U.S. Cl. ..... 211/46; 312/184

[58] Field of Search ..... 211/46, 45, 113; 312/184, 183

[56] References Cited

U.S. PATENT DOCUMENTS 2,969,793 1/1961 Fürrer ..... 312/184 X
3,790,242 2/1974 Sullivan ..... 312/184
3,865,445 2/1975 Dean et al. ..... 312/184
4,009,784 3/1977 Elias et al. ..... 211/46
4,171,854 10/1979 Hedstrom et al. ..... 312/184

FOREIGN PATENT DOCUMENTS 516287 1/1953 Belgium ..... 312/184

*Primary Examiner*—Alvin C. Chin-Shue
*Assistant Examiner*—Sarah A. Lechok
*Attorney, Agent, or Firm*—Flynn, Thiel, Boutell & Tanis

[57] ABSTRACT

Support for print-outs which is suitable to bear print-outs along the axis of the support (10) and which includes on a central body (11) terminal attachments (13) and a central attachment (12) and also a handle (14), side panels (17) being comprised at the sides of the central body (11) symmetrically along the length of the central body (11).

10 Claims, 2 Drawing Sheets

SUPPORT FOR PRINT-OUTS

This invention concerns a support for print-outs. To be more exact, the invention concerns a support which can be hung and/or carried and which is suitable to uphold, position and secure print-outs arranged vertically.

The support according to the invention is able to be hung on monorail supports or on support points spaced apart and to bear print-outs below itself.

Supports for print-outs of the type in question are known but entail many drawbacks as regards their application and use.

The present applicant has designed, tested and embodied this invention so as to obviate such drawbacks.

According to the invention a support for print-outs consists of a central body and of two side panels positioned diametrically opposite to each other in relation to the body and along the length of the body.

Each of the side panels consists of an inner portion and an outer portion, both of which can be folded lengthwise as required.

The body comprises terminal attachments and a central attachment and also a handle to carry the support and a window for the application of information regarding the contents of the print-outs.

According to the invention the body includes also at least one terminal limiting means able to position the print-outs lengthwise within the support.

The outer portions of the side panels comprise holes that cooperate with guides within which there can run sliders that are suitable to secure clamping means, which may be means comprising a cord or pin.

The invention is therefor embodied with a support for print-outs according to the contents of claim 1 and the dependent claims.

Let us now see a preferred embodiment of the invention with the help of the attached figures, which are given as a nonrestrictive example and show the following:

FIG. 1 shows a side view of a support according to the invention;

FIG. 2 gives a plan view of a support according to FIG. 1;

Figure 1:
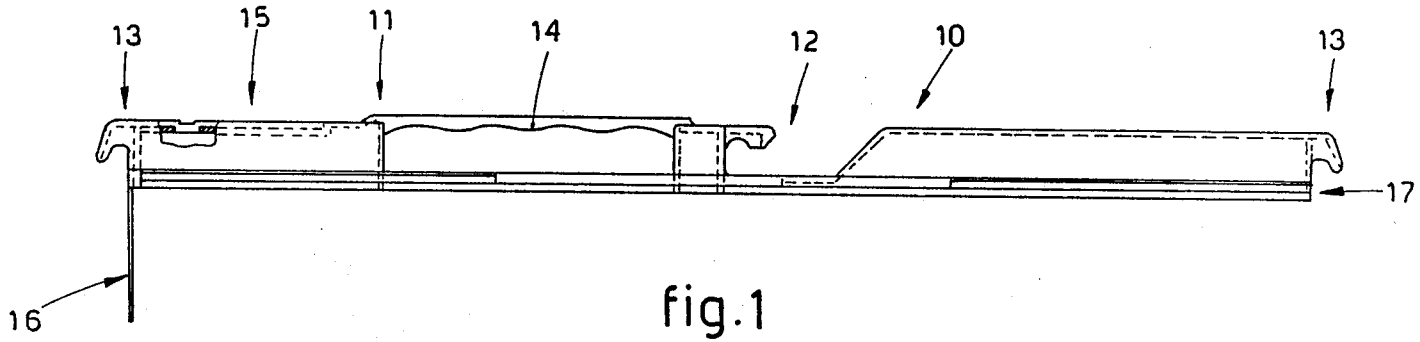

According to the invention a support 10 for print-outs comprises a body 11 equipped in a specific manner. The body 11 includes at its ends terminal attachments 13 and at its centre a central attachment 12.

The terminal attachments 13 serve for the support to be upheld on support points spaced apart, whereas the central attachment 12 serves for the support to be upheld on substantially T-shaped central rail attachments.

A handle 14 is included in an intermediate position for the carrying of the support, while a window 15 is provided in an upper portion of the central body for the application of information regarding the contents of the print-outs hanging from the support.

Two side panels 17, each of them consisting of an inner portion 18 and a outer portion 118, are comprised on the two lengthwise sides of the body 11. The portions can be folded along preferred lines in relation to the body and to each other along their length. That is, the inner portions 18 are longitudinally pivotally connected to the body 11, and the outer portions 118 are longitudinally pivotally connected to the inner portions 18.

The outer portions 118 include a coordinated plurality of holes 19 suitably spaced apart, which cooperate with guides 20. The holes 19 and guides 20 are distributed longitudinally along the outer portions 118.

Figure 4:
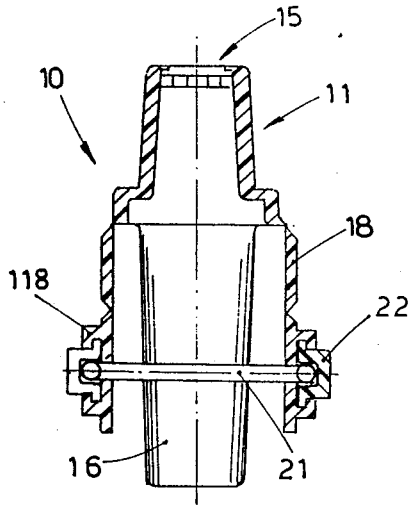
FIGS. 4 and 5 show two conditions of use of the embodiment of FIG. 1.
Figure 5:
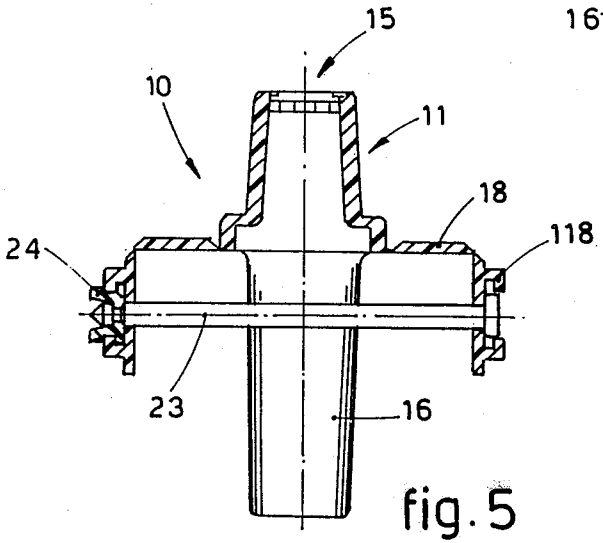
Figure 3:
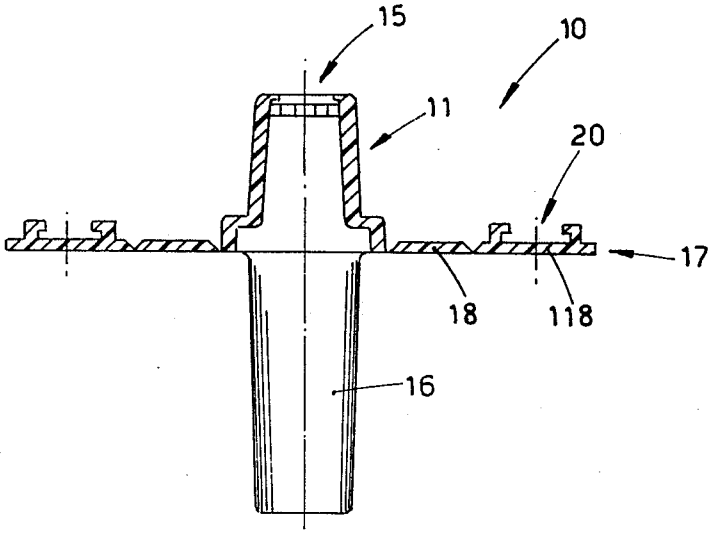
FIG. 3 shows a cross section of the embodiment of FIG. 1.

The outer portions 118 alone (FIG. 5) or the inner portions 18 too (FIG. 4) may be folded, depending on the quantity of the print-outs to be held.

The reciprocal connection of the portions 18–118 of the side panels can be provided by a cord 21 (FIG. 4) or by pins 23 (FIG. 5) which are received in the holes 19.

Figure 2:
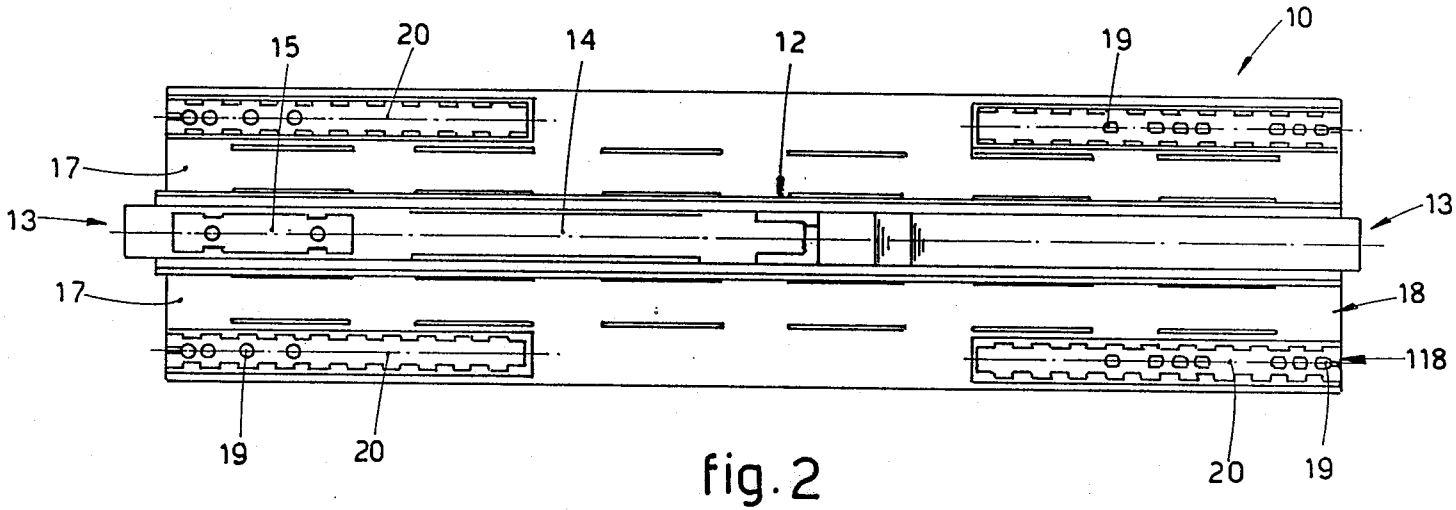

Sliders 22 for cord or sliders 24 for pins can cooperate in guides 20, depending on the type of connection and support to be provided. The sliders 22, 24 are slidably movable in the guides 20 to locations adjacent respective holes 19, where the sliders secure the cord 21 or pins 23 which are received in the holes 19. The guides 20 are disposed relative to the holes 19 so as to facilitate positioning the sliders adjacent a selected hole (see FIG. 2).

We claim:

1. A support for print-outs which is suitable to bear print-outs along the axis of the support itself (10), comprising: a generally rectangular central body having terminal ends, sides and a center and further (11) having support attachments (12,13) located longitudinally at said terminal ends and center for facilitating hanging the support, a handle (14) on said central body for carrying the support, side panels (17) located symmetrically at the sides and along the length of the central body (11), the central body (11) including at least one terminal limiting means (16) for positioning print-outs longitudinally within the support, each of the side panels (17) including an inner portion (18) adjacent the central body and an outer portion (118) adjacent the inner portion and spaced from the central body, the inner portion being pivotally connected to the central body for pivotal movement thereabout, and the outer portion being pivotally connected to the inner portion for pivotal movement thereabout.

2. A support as claimed in claim 1, wherein the central body (11) includes an upper portion having at least one window (15).

3. A support as claimed in claim 1, wherein the outer portion (118) includes a plurality of holes (19) formed therein and distributed longitudinally therealong, said holes receiving clamping means (21, 23) for binding print-outs within the support, said outer portion further including guides (20) extending longitudinally thereon and sliders (22, 24) slidably movable in said guides, said sliders being adapted to secure said clamping means in said holes, said guides being disposed relative to said holes so as to facilitate selective positioning of said sliders adjacent respective said holes.

4. An apparatus for releasably bindingly supporting sheets of paper, comprising:

an elongate main body having means thereon for facilitating hanging support of said main body;

side panels extending longitudinally along opposite sides of said main body, each said side panel including an inner portion adjacent said main body and pivotally connected thereto for pivotal movement thereabout, each said side panel further including an outer portion spaced from said main body and adjacent said inner portion, said outer portion being pivotally connected to said inner portion for pivotal movement thereabout; and binding means cooperable with said outer portions of said side panels for binding sheets of paper.

5. The apparatus of claim 4, wherein said hanging support facilitating means includes support attachments on said main body at the ends and center thereof.

6. The apparatus of claim 4, wherein said hanging support facilitating means includes a handle on said main body.

7. The apparatus of claim 4, wherein said main body includes limiting means for longitudinally positioning sheets of paper relative to said main body.

8. The apparatus of claim 4, wherein said outer portions of said side panels include holes formed therein and distributed longitudinally therealong for receiving said binding means, said outer portions further including guides extending longitudinally thereon and sliders slidably movable in said guides, said sliders being adapted to secure said binding means in said holes.

9. The apparatus of claim 8, wherein said guides are disposed relative to said holes so as to facilitate selective positioning of said sliders adjacent respective said holes.

10. The apparatus of claim 4, wherein said main body includes a window for displaying informative labels.

* * * * *